US007175688B2

(12) United States Patent
Matsuki

(10) Patent No.: US 7,175,688 B2
(45) Date of Patent: Feb. 13, 2007

(54) NI-FE BASED ALLOY POWDER

(75) Inventor: Kensuke Matsuki, Chiba (JP)

(73) Assignee: Kawatetsu Mining Co., Ltd., Tokyo (JP)

( * ) Notice: Subject to any disclaimer, the term of this patent is extended or adjusted under 35 U.S.C. 154(b) by 131 days.

(21) Appl. No.: 10/498,127

(22) PCT Filed: Dec. 26, 2002

(86) PCT No.: PCT/JP02/13703

§ 371 (c)(1),
(2), (4) Date: Jun. 9, 2004

(87) PCT Pub. No.: WO03/056048

PCT Pub. Date: Jul. 10, 2003

(65) Prior Publication Data

US 2005/0005734 A1 Jan. 13, 2005

(30) Foreign Application Priority Data

Dec. 27, 2001 (JP) ..... 2001-397019

(51) Int. Cl.
*B22F 1/00* (2006.01)

(52) U.S. Cl. ..... 75/255

(58) Field of Classification Search ..... 75/255
See application file for complete search history.

(56) References Cited

U.S. PATENT DOCUMENTS 2,006,987 A * 7/1935 Duftschmid ..... 75/246
4,381,943 A * 5/1983 Dickson et al. ..... 75/356
5,352,268 A * 10/1994 Meguro et al. ..... 75/338
2001/0009118 A1* 7/2001 Hosoe et al. ..... 75/255

FOREIGN PATENT DOCUMENTS

| | | |
|---|---|---|
| JP | A 1-294801 | 11/1989 |
| JP | A 5-247506 | 9/1993 |
| JP | A 2001-6151 | 1/2001 |
| JP | A 2002-266005 | 9/2002 |

* cited by examiner

*Primary Examiner*—Ngoclan T. Mai
(74) *Attorney, Agent, or Firm*—Oliff & Berridge, PLC

(57) ABSTRACT

A Ni—Fe based alloy powder of the present invention contains not less than 90% by a combined mass of Ni and Fe and homogeneously has particles having an average particle diameter from 0.1 to 1 μm, and an average value of mass ratio Fe/(Fe+Ni) from 15% to 25% both inclusive, wherein the ratio of a maximum value X and a minimum value Y of Fe/(Fe+Ni), which are found at individual points in the region ranging from the center of any particle of the alloy powder to locations apart by 0.9 fold of the particle radius therefrom, X/Y is from 1 to 2. By producing a sintered part using this Ni—Fe based alloy powder as a raw material powder, it is possible to obtain electronic circuit parts which are homogenous and have high magnetic permeability.

2 Claims, 2 Drawing Sheets

NI-FE BASED ALLOY POWDER

TECHNICAL FIELD

The present invention relates to a Ni—Fe based alloy powder used as an alloy powder for a paste filler. More specifically, it relates to a Ni—Fe based alloy powder used as a material for various electronic circuit parts, such as a noise filter, a choke coil, an inductor and a magnetic head, radio wave absorbents and the like that require high magnetic permeability.

BACKGROUND ART

There is known a Ni—Fe alloy having very high magnetic permeability, which is generally called Permalloy. For example, the proportion of direct current components is great in a noise filter for high frequency waves which is used in an A-D converter of a switching power supply of a small-size electronic device, and therefore a Ni—Fe alloy having a high saturation magnetization value and high magnetic permeability exhibits its excellent function. Parts of electronic devices, such as a core for a noise filter, are often produced mainly by molding a mixture of an alloy powder and a resin or by compacting an alloy powder by a powder metallurgical process.

A Ni—Fe alloy powder which is used as a material for parts of various electronic devices has hitherto been produced by the gas atomization method or the mechanical pulverization method depending upon a use theref or. However, a Ni—Fe based alloy powder of submicron particle size which has a homogenous composition and high magnetic permeability has not yet been known.

A Ni—Fe based alloy has high ductility and, therefore, it is impossible to pulverize this alloy powder into one having particles with submicron size. Besides, in the pulverization process plastic strains are introduced and magnetic properties deteriorate. Therefore, it was impossible to utilize the high magnetic permeability which Ni—Fe alloys inherently have. In addition, although this powder has good formability, its productivity is low since high temperatures of 1000° C. or more are required in order to obtain sufficient sintered density. A powder produced by the gas atomization method is inferior in compactibility and is not easy to compact. Further, it is impossible to produce thin films of several micrometers in thickness using these powders, because the particle diameter of these conventional powders is usually as large as dozens of micrometers or more.

In the present invention, there is provided a technique for improving the Permalloy alloy, although its magnetic permeability is high, which has drawback properties in high frequency band because of low electrical resistivity, and for making this alloy usable in the MHz (megahertz) band and in the higher frequency bands. For this purpose, it must be ensured that thin films of about 5 μm or less in thickness can be produced. Such thin films cannot be produced by rolling.

DISCLOSURE OF THE INVENTION

The present invention provides a technique which permits the fabrication of thin parts having such thicknesses. The present invention has as an object to provide a Ni—Fe based alloy powder from which a Permalloy head or magnetic core having a thickness of about 1 μm for example, can be produced.

The present invention was made to achieve the above object and there is provided a Ni—Fe based alloy powder which contains not less than 90% by a combined mass of Ni and Fe, which is characterized in that the Ni—Fe based alloy powder contains particles having an average particle diameter from 0.1 to 1 μm, and an average value of mass ratio Fe/(Fe+Ni) from 15% to 25% both inclusive, wherein the ratio of a maximum value X and a minimum value Y of Fe/(Fe+Ni), which are found at individual points in the region ranging from the center of a particle of the alloy powder to locations apart by 0.9 fold of the particle radius therefrom, X/Y is from 1 to 2. In this case, it is more preferred that the average value of Fe/(Fe+Ni) in the alloy powder be not less than 18% but not more than 22%.

The above-described values of X and Y are respectively a maximum value and a minimum value of Fe/(Ni+Fe) which are obtained by analyzing the section of an arbitrary particle of a powder embedded in a resin, which is cut by a focused ion beam (FIB) processing device, by use of the energy dispersive X-ray spectroscopy (EDX). That the ratio X/Y is 1 to 2 ensures the homogeneity of the composition in the interior of a particle. The reason why the composition in the interior of a particle in the region ranging from the center of the particle to locations apart by 0.9 fold of the particle radius is adopted is that the surface of the particle is regarded as being affected by oxidation and hence excluded and that the homogeneity is judged from the condition of the interior of the particle which is not affected by oxidation.

Furthermore, it is preferred that the above-described Ni—Fe based alloy powder be homogeneous to such an extent that the total of particles in which the above-described ratio X/Y within each particle is 1 to 2 is not less than 80 mass % of the whole powder.

Incidentally, the Ni—Fe based alloy described in the present invention includes a Ni—Fe binary alloy. The average particle diameter is measured by an image analysis of a scanning electron microscope.

According to the present invention, it is possible to provide a Ni—Fe based alloy particle which has high magnetic permeability and has excellent properties in high frequency. Therefore, a Ni—Fe based alloy powder of the present invention is expected to play an important role in the future as a material for electronic parts capable of coping with the technical trends in which the high frequency design and miniaturization of electronic equipment are rapidly moving forward.

BEST MODE FOR CARRYING OUT THE INVENTION

A Ni—Fe based alloy powder of the present invention will be described in further detail below. For a Ni—Fe based alloy powder of the present invention, the Ni and Fe contents as a total should be 90 mass % or more. If the total of Ni and Fe contents is less than 90 mass %, the magnetic flux density decreases and the magnetic permeability deteriorates. Therefore, this is no good. Incidentally, components of the above-described Ni—Fe based alloy powder other than Ni and Fe are not especially limited. In order to improve electromagnetic properties of Ni—Fe based alloys, such as magnetic permeability, one or more kinds of components selected from components which have hitherto been usually used in various types of Permalloy, for example, Mo, Co, Ti, Cr, Cu and Mn, may be contained.

For the Ni and Fe contents of a Ni—Fe based alloy powder of the present invention, the Ni—Fe based alloy powder contains 75 to 85 mass % Ni and 15 to 25 mass % Fe with respect to the total amount of Ni and Fe. This is because the characteristic required of materials to which the present invention is applied is high magnetic permeability. That is, if these contents deviate from this composition range, the initial magnetic permeability becomes 2000 or less and it is impossible to meet the requirement for materials of high magnetic permeability. It is more preferred that the Ni content be 78 to 82 mass % and the Fe content be 18 to 22 with respect to the total amount of Ni and Fe.

Figure 3:
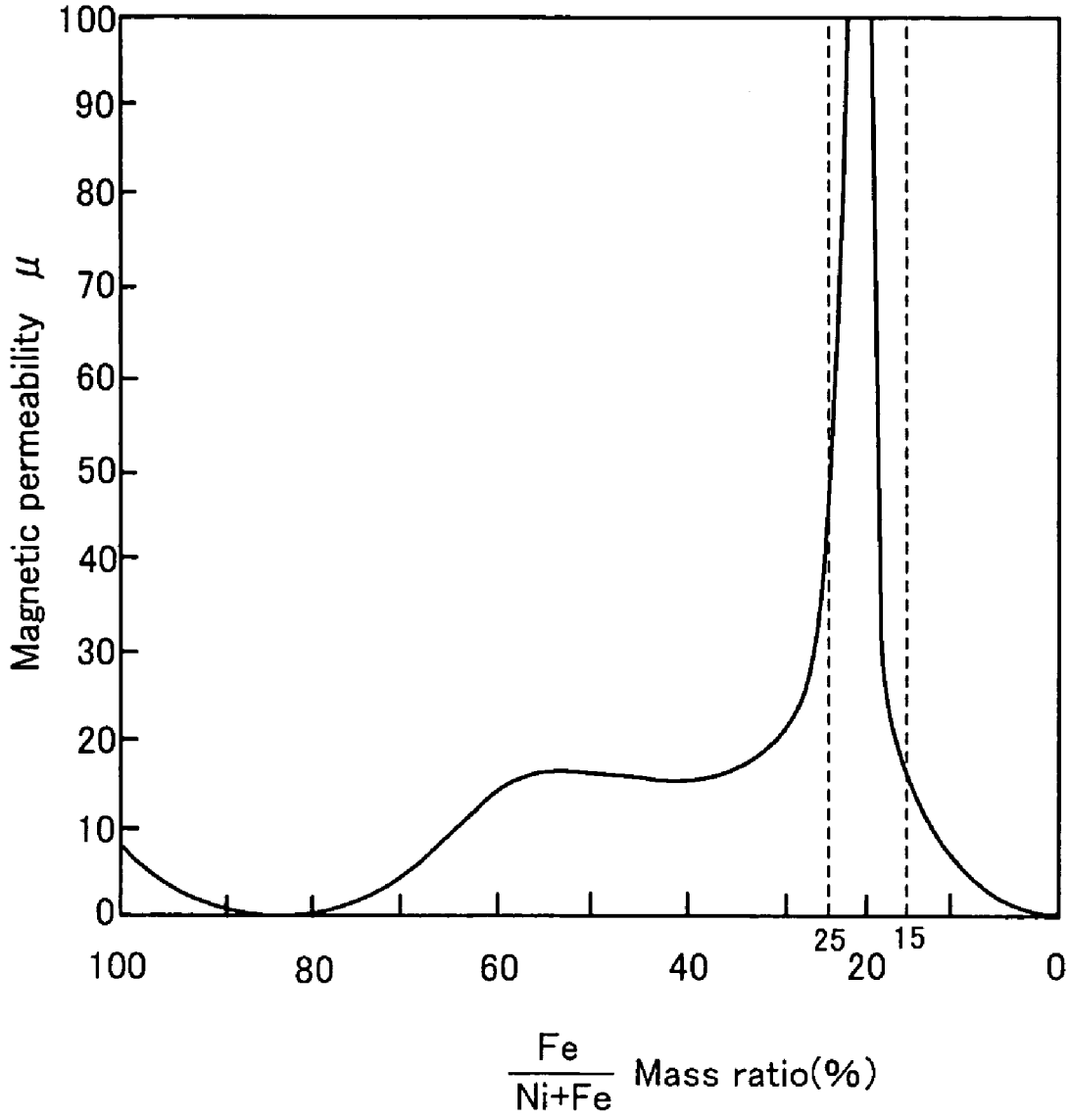
FIG. 3 is a graph showing the relationship between the Fe content and magnetic permeability of a Ni—Fe based alloy, which represents a characteristic of the alloy.

FIG. 3 is a graph of a characteristic curve showing the relationship between the mass ratio Fe/(Ni+Fe) (%) and magnetic permeability in a Ni—Fe based alloy, with the former as abscissa and the latter as ordinate. Magnetic permeability shows a remarkable peak when the value of Fe/(Ni+Fe) is near 20% and an excellent property is displayed when the value of Fe/(Ni+Fe) is 15 to 25% near 20%. The value of Fe/(Ni+Fe) is more preferably 18 to 22%.

The Ni and Fe contents can be changed by adjusting the mixing ratio of an Ni chloride (for example, $NiCl_2$) and an Fe chloride (for example, $FeCl_3$) in the raw material and adjusting conditions such as the reaction temperature as required.

The average particle diameter of a Ni—Fe based alloy powder should be 0.1 to 1.0 μm. It is necessary to control the average particle diameter to the above-described range in order to obtain at low sintering temperature a magnetic material layer which has desired sufficient magnetic properties and a thin sheet thickness and is dense. This particle diameter range can be obtained under conditions for producing a very fine powder by using the CVD (chemical vapor deposition) process. This pulverization of a Ni—Fe based alloy powder has not been realized in conventional products. Since this fine Ni—Fe based alloy powder has been obtained, it becomes possible to produce parts having a thin film, producing the advantage that a reduction in magnetic losses in the high frequency band is realized and that the higher frequency design of electronic equipment can be achieved.

An ultrafine particle whose average particle diameter of a powder is less than 0.1 μm is difficult to handle in the air because of the high surface activity of the powder and the production efficiency is greatly impaired. On the other hand, when the average particle diameter exceeds 1.0 μm, it is necessary to substantially lengthen the reaction time of CVD process and the production efficiency is greatly impaired, resulting in lowered economical efficiency.

A Ni—Fe based alloy powder meeting the above conditions can be advantageously produced by the CVD process by appropriately controlling various conditions during production.

Concrete conditions for the CVD process can be obtained by appropriately selecting and setting various conditions, such as the blending ratio of raw material chlorides in raw materials, reaction temperature and reactive gas flow rate, as required in consideration of the production efficiency of powder manufacturing, tolerances within a target composition range and the like.

EXAMPLE 1

A Ni—Fe based alloy powder was produced by use of a Chemical Vapor Deposition (CVD) apparatus with industrial scale.

A mixture of $NiCl_2$ having a purity of 99.5 mass % and $FeCl_3$ having a purity of 99.5 mass %, which was adjusted so as to have an Fe/(Ni+Fe) value of 20% was continuously charged into this apparatus. This mixture was heated to 900° C. and brought into a vaporized state and the vapor of $NiCl_2$ and the vapor of $FeCl_3$ were caused to react with each other in the above reactor by use of argon gas as a carrier gas. And on the outlet side of the reactor, the chloride vapors and hydrogen gas were brought into contact with each other and mixed together, whereby a reduction reaction was caused to occur and a fine powder of a Ni—Fe alloy was produced.

The generated powder thus obtained contained 79.6 mass % Ni, 19.8 mass % Fe and a small amount of oxygen. The Ni and Fe contents were measured by the wet process. For the powder characteristics, the specific surface area measured by the BET method was 2.92 $m^2/g$ and the average particle diameter measured by an image analysis by use of a scanning electron microscope was 0.23 μm. Next, the powder was applied to an alumina substrate by the bar coater method and sintered at 1000° C. to form a single-layer film having a thickness of 4 μm, and the value of magnetic permeability (p) in an AC magnetic field of 10 MHz was measured.

TABLE 1

| | Ni + Fe content (mass %) | Ni content (mass %) | Fe content (mass %) | Average particle size (μm) | Fe/ (Fe + Ni) mass ratio (%) | Fe content in a particle (mass %) | Maximum value X of Fe concentration in a particle by EDX | Maximum value Y of Fe concentration in a particle by EDX | Ratio of maximum and minimum values of Fe concentration X/Y | Abundance of particles having X/Y of 1 to 2 (mass %) | Magnetic permeability at 10 MHz (film thickness: 4 μm) |
|---|---|---|---|---|---|---|---|---|---|---|---|
| Example 1 | 99..4 | 79.6 | 19.8 | 0.23 | 20.1 | 20.2 | 21.0 | 19.1 | 1.1 | 92 | 600 |
| Example 2 | 98.0 | 78.1 | 19.9 | 0.3 | 20.3 | 20.1 | 22.0 | 18.3 | 1.2 | 90 | 580 |
| Example 3 | 98.0 | 78.7 | 19.3 | 0.35 | 19.7 | 19.9 | 24.5 | 16.3 | 1.5 | 90 | 550 |
| Example 4 | 98.0 | 78.6 | 19.4 | 0.45 | 19.8 | 19.6 | 28.3 | 14.2 | 2.0 | 90 | 500 |
| Comparative Example 1 | 98.0 | 77.8 | 20.2 | 0.4 | 20.6 | 20.5 | 34.6 | 11.5 | 3 | 10 | 150 |
| Comparative Example 2 | 98.0 | 78.2 | 19.8 | 0.4 | 20.2 | 20.3 | 38.0 | 5.0 | 7.6 | 0 | 100 |

EXAMPLES 2 TO 4, COMPARATIVE EXAMPLES 1 AND 2

Ni—Fe based alloy powders of Examples 2 to 4 and Comparative Examples 1 and 2 were produced by using a Chemical Vapor Deposition (CVD) apparatus in the same manner as in Example 1 and evaluated also as in Example 1. Different volumes of hydrogen required for reduction were used in Examples 1 to 4 and Comparative Examples 1 and 2. In Example 1, the volumes of hydrogen was tens fold of the theoretical volume, while the volumes of hydrogen was decreased gradually in order of Examples 2, 3 and 4, and Comparative Examples 1 and 2. In Comparative Example 2, the volumes of hydrogen was equal to the theoretical volume.

Measurement results of Examples 1 to 4 and Comparative Examples 1 and 2 described above are shown in Table 1. The Fe content in a particle in Table 1 is the value of Fe/(Fe+Ni) in a particle measured by EDX, and in this measurement the beam diameter of EDX was adjusted to a particle diameter. As is apparent from Table 1, the Ni—Fe based alloy powders of the present invention have excellent magnetic characteristics represented by a magnetic permeability at 10 MHz.

Figure 1:
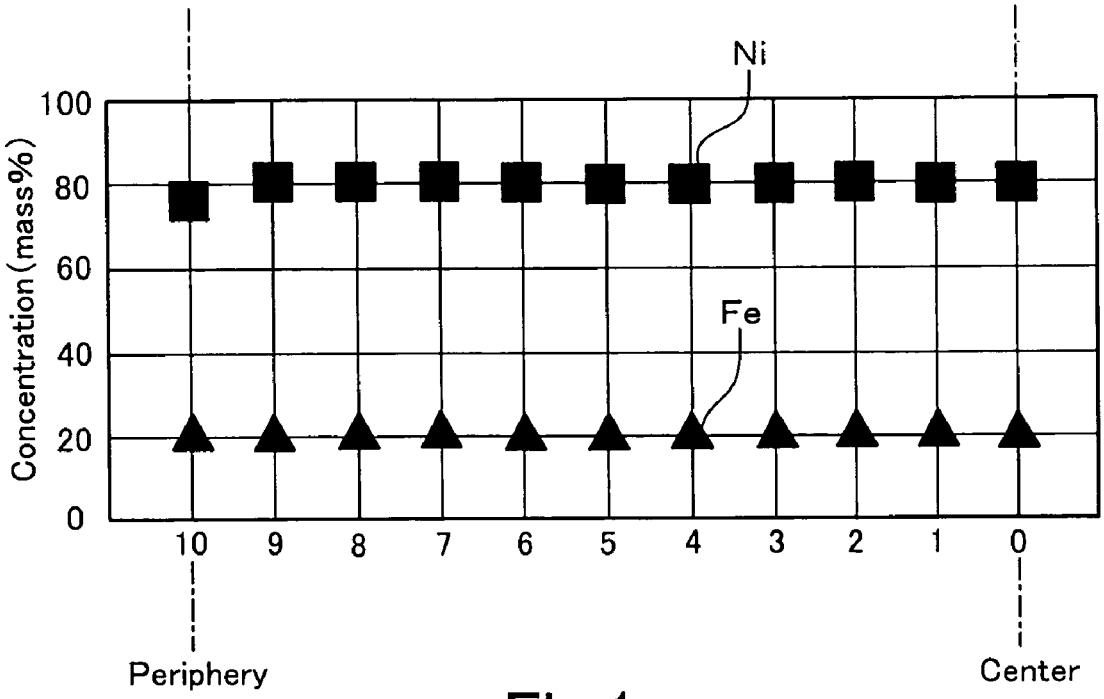
FIG. 1 is a graph showing the distribution of components in the interior of a particle of Embodiment 1.
Figure 2:
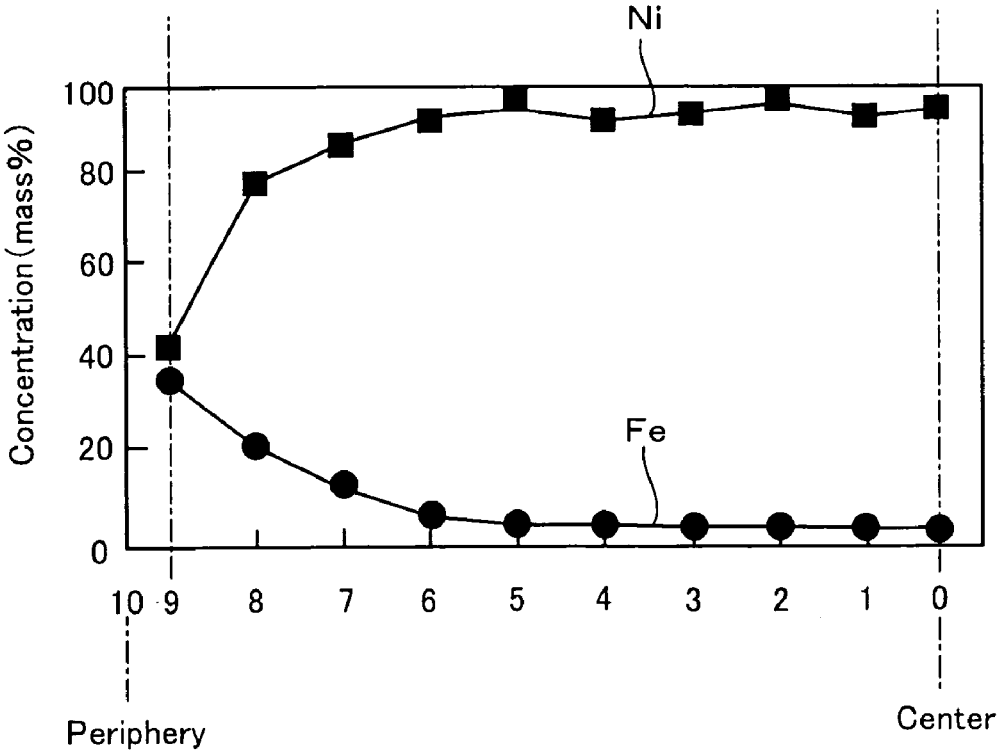
FIG. 2 is a graph showing the distribution of components in the interior of a particle of Embodiment 2.

An exemplary distribution of Fe and Ni within a particle of Example 1 shown in Table 1 is illustrated in FIG. 1. The abscissa of FIG. 1 indicates positions in a particle. The central position of the particle is indicated by 0, the surface of the particle is indicated by 10, and the distance between the center and the surface is divided into 10 equal parts. The ordinate indicates the Ni and Fe concentrations. The distribution of Ni and Fe concentrations in a region not affected by oxidation from the center of the particle to 0.9 time the particle radius is within the ranges of 80±1.0 mass % and 20±1.0 mass %, respectively. An exemplary distribution of Ni and Fe in the interior of a particle of Comparative Example 2 is shown in FIG. 2 as in FIG. 1. In Comparative Example 2, Fe is concentrated near the surface and the Fe concentration in the center decreases to 5 mass %. Thus the homogeneity of the concentrations in the interior of a particle is not obtained.

The invention claimed is:

1. A Ni—Fe based alloy powder containing not less than 90% by a combined mass of Ni and Fe, characterized in that the Ni—Fe based alloy powder contains particles having an average particle diameter from 0.1 to 1 μm, and an average value of mass ratio Fe/(Fe+Ni) from 15% to 25% both inclusive, wherein the ratio of a maximum value X and a minimum value Y of Fe/(Fe+Ni), which are found at individual points in the region ranging from the center of a particle of the alloy powder to locations apart by 0.9 fold of the particle radius therefrom, X/Y is from 1 to 2.

2. The Ni—Fe based alloy powder according to claim 1, characterized in that the total mass of particles in which the ratio X/Y is from 1 to 2 is not less than 80% based on the mass of the whole powder.

* * * * *